United States Patent [19]

Reuffurth et al.

[11] Patent Number: 4,948,399

[45] Date of Patent: Aug. 14, 1990

[54] CORONA ELECTRODE FOR DUST-COLLECTING ELECTROSTATIC PRECIPITATOR

[75] Inventors: Rainer Reuffurth, Offenbach; Hermann Koy, Alzenau-Albstadt, both of Fed. Rep. of Germany

[73] Assignee: Metallgesellschaft Aktiengesellschaft, Frankfurt am Main, Fed. Rep. of Germany

[21] Appl. No.: 351,622

[22] Filed: May 12, 1989

[30] Foreign Application Priority Data

May 17, 1988 [DE] Fed. Rep. of Germany ..... 3816717

[51] Int. Cl.[5] ..... B03C 3/00

[52] U.S. Cl. ..... 55/148; 55/152

[58] Field of Search ..... 55/150–152, 55/140, 141, 147, 148; 403/347, 339, 340, 341; 361/230

[56] References Cited

U.S. PATENT DOCUMENTS

| | | | |
|---|---|---|---|
| 925,293 | 6/1909 | Cheney | 403/340 |
| 1,391,364 | 9/1921 | Bulow | 403/340 |

FOREIGN PATENT DOCUMENTS

| | | | |
|---|---|---|---|
| 2546305 | 4/1981 | Fed. Rep. of Germany . | |
| 3130548 | 2/1983 | Fed. Rep. of Germany | 55/150 |
| 2603514 | 6/1984 | Fed. Rep. of Germany . | |

*Primary Examiner*—Bernard Nozick

*Attorney, Agent, or Firm*—Herbert Dubno; Andrew Wilford

[57] ABSTRACT

In order to improve the arrangement and fixation of corona electrodes in a tensioning frame it is proposed to provide the corona electrodes with end portions which are semicircular in cross-section. This will permit the end portions of the electrodes to be joined to the tubes of the tensioning frame by welding at two points whereas the corona points need not be appreciably spaced from the electrical center.

6 Claims, 3 Drawing Sheets

Fig. 2
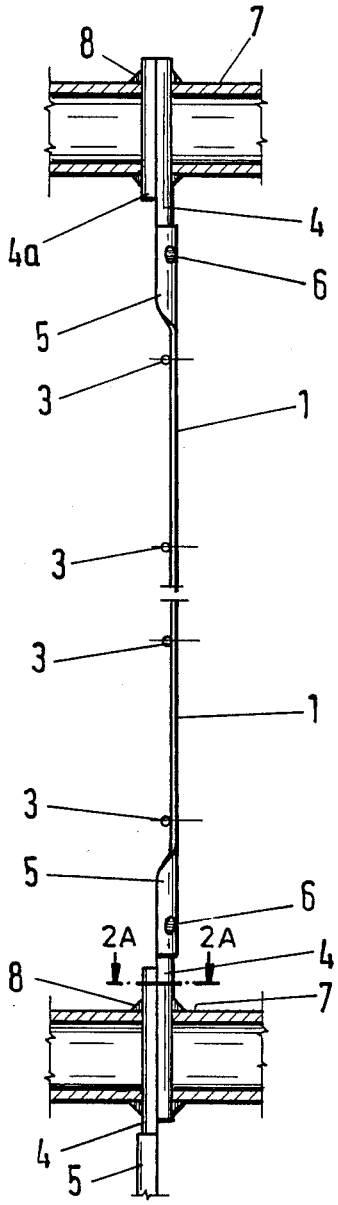
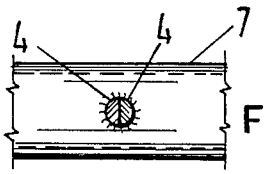
FIG.2A
Fig. 3
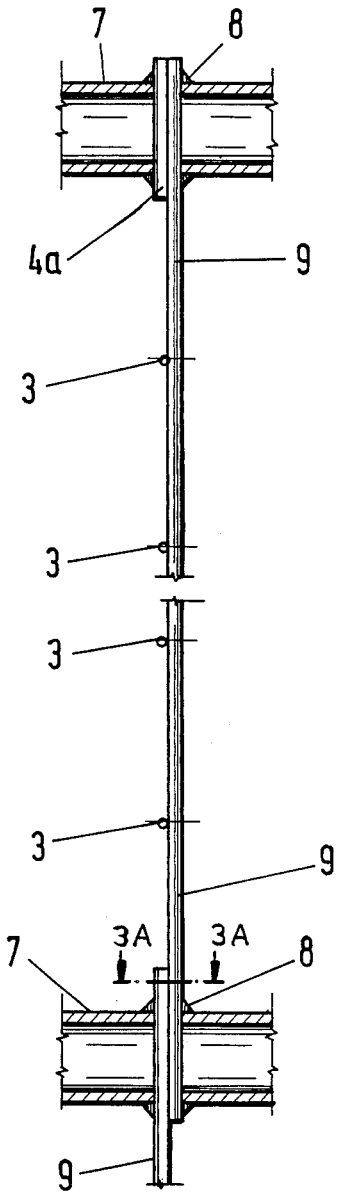
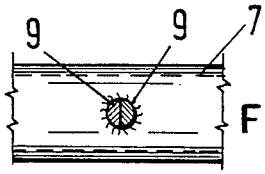
FIG.3A

CORONA ELECTRODE FOR DUST-COLLECTING ELECTROSTATIC PRECIPITATOR

Field of the Invention

My present invention relates to a corona electrode or electrode assembly for electrostatic precipitation.

More particularly, the invention relates to such assemblies wherein each corona electrode consists of an elongate strip or wire body having protruding corona points, for use in dust-collecting electrostatic precipitators in which vertical collecting electrode walls which define gas passage and tensioning frames which are assembled from tubes are arranged in alternation in a sequence which is transverse to the direction of gas flow and in which a plurality of corona electrodes are inserted at their top and bottom ends in bores of the horizontal tubes of the tensioning frames and are welded thereto.

Background of the Invention

Examples of such corona electrodes have been disclosed in German Patents Nos. 25 46 305 and 36 03 514 in connection with tensioning devices which have specifically been developed for such electrodes. Each electrode essentially consists of a narrow metal strip which is integrally formed with projections and is provided with so-called weld-on end portions. The latter consists of portions of a round wire that for the fixation of the corona electrodes are inserted into circular throughgoing bores of the tubes of the tensioning frame and are welded to such tubes.

In other known corona electrodes, the corona points consist of separate wire portions which may have pointed ends and have been joined to the elongate strip or wire body of the corona electrode.

In spite of highly developed tensioning and fixing technologies, these known corona electrodes still have various disadvantages.

A frequently observed weak point is the welded joint between the corona electrode proper and the weld-on end portions. When corona electrodes rupture under the combined loads which are due to the influences of tensioning forces, shaking for cleaning, temperature, voltage and corrosion, such rupture will most often occur in that transitional region. This is important in that this region not have appreciable electric contact resistances.

A further problem will arise if the vertical dimension of a dust-collecting electrostatic precipitator is so large that it exceeds the largest possible length in which a corona electrode can be tensioned so that the tensioning frames must be divided in height.

Because the collecting electrodes may easily be made and used in lengths 4.5 to 15.5 m but in view of a limitation of the tensioning forces and because uncontrolled vibration is to be avoided, corona electrodes cannot be tensioned in lengths exceeding 2.5 to 3.0 m. two or more corona electrode lengths must be associated with each of the collecting electrodes, which have a uniform design throughout their length.

For an optimum operation of the dust-collecting electrostatic precipitator the corona electrodes must be exactly positioned relative to the corona electrodes. The best position is usually described as the "electrical center". It is not easy to locate the corona electrode at the center when an upwardly extending corona electrode and a downwardly extending one are to be secured at the same point in a horizontal tube.

It is possible either to slightly offset the electrodes from the electrical center or to provide the tube with two offset throughgoing bores or to insert the ends of the top and bottom corona electrodes in one and the same throughgoing bore if the ends of the electrodes are sufficiently short and are welded only to the top and bottom portions, respectively, of the tube wall. The variant mentioned last has been found to be highly susceptible to fracture.

Objects of the Invention

For this reason it is an object so to design corona electrodes which are of the kind described hereinbefore that they can be secured in the tensioning frames in a manner which is reliable in operation and that allows a plurality of corona electrode lengths to be arranged one over the other without departing from the electrical center by more than the absolutely necessary extent.

Another object of our invention is to provide a corona electrode assembly for an electrostatic precipitator of the type described which avoids the drawbacks of the prior art.

Summary of the Invention

These objects are thus accomplished in that at least the end portions of the corona electrodes are semicircular in cross-section. In accordance with a further feature of the invention the elongate body of the corona electrode is semicircular in cross-section throughout its length.

It will readily be appreciated that this will permit the end portions of two corona electrodes to be secured in one and the same throughgoing bore and that any departure from the electrical center will be due only to the shape or design of the corona electrodes rather than to the necessity to jointly fix the corona electrodes to the tensioning frame at the same location.

If it is assumed that from the aspect of strength the semicircular cross-section must not be smaller than the round cross-section which has been used before, it will be necessary to increase the diameter of the bore by about 40%. But it has been found that the correspondingly smaller length of the seam weld by which each semicircular end portion of the corona electrodes is secured in the tube will be sufficient in any case. The end portion may additionally be welded to the end portion of the corona electrode which extends in the opposite direction from the tube. In the uppermost and lowermost tubes of the tensioning frames the cross-section of the throughgoing bore will be occupied not only by the end portion of the corona electrode but also by a semicircular piece of material so that the fixation will be of the same kind and provide the same safety as in the intermediate tubes.

If the previously usual welded joint between the weld-on end portion and the strip body of the corona electrode properly shall be omitted the latter may be semicircular in cross-section throughout its length and may be provided with attached corona points. Although this involves a somewhat higher expenditure of material than the striplike corona electrodes having conventional dimensions, the higher expenditures will be more than offset by the longer life which is to be expected.

More specifically, the invention comprises a corona electrode assembly for an electrostatic precipitator which comprises:

a corona electrode assembly for an electrostatic precipitator in which a plurality of the assemblies alternate with dust-collecting electrodes, the assembly comprising:

a tensioning frame having at least three mutually parallel spaced-apart tubes; and a plurality of corona electrodes spanning between the tubes, the tubes being formed with circular holes, the corona electrodes each having an elongated shank formed with protruding corona points and respective end portions of semicircular cross section, the end portions of two of the electrodes being received in a respective one of the holes of a respective tube and being welded thereto.

The electrode structure itself maybe defined as follows:

a corona electrode for an electrostatic precipitator in which a plurality of corona electrode assemblies alternate with vertical dust-collecting electrodes defining passages for a gas through the electrostatic precipitator and wherein the assemblies are formed with tensioning frames assembled from tubes, the corona electrode comprising an elongated shank formed with protruding corona points and respective end portions of semicircular cross section, whereby the end portions of two such electrodes can be received in a respective circular hole of a respective tube and welded thereto.

Brief Description of the Drawing

The above and other objects, features and advantages of my invention will become more readily apparent from the following description, reference being made to the accompanying highly diagrammatic drawing in which:

FIG. 2 is a partially sectional view which shows a joint between a corona electrode and a tensioning frame in accordance with the invention;

FIG. 2A is a section along the line IIA—IIA of FIG. 2;

FIG. 3 is a view similar to FIG. 2 illustrating another embodiment of the invention;

FIG. 3A is a cross sectional view taken along the line IIIA—IIIA of FIG. 3.

Specific Description

Figure 4:
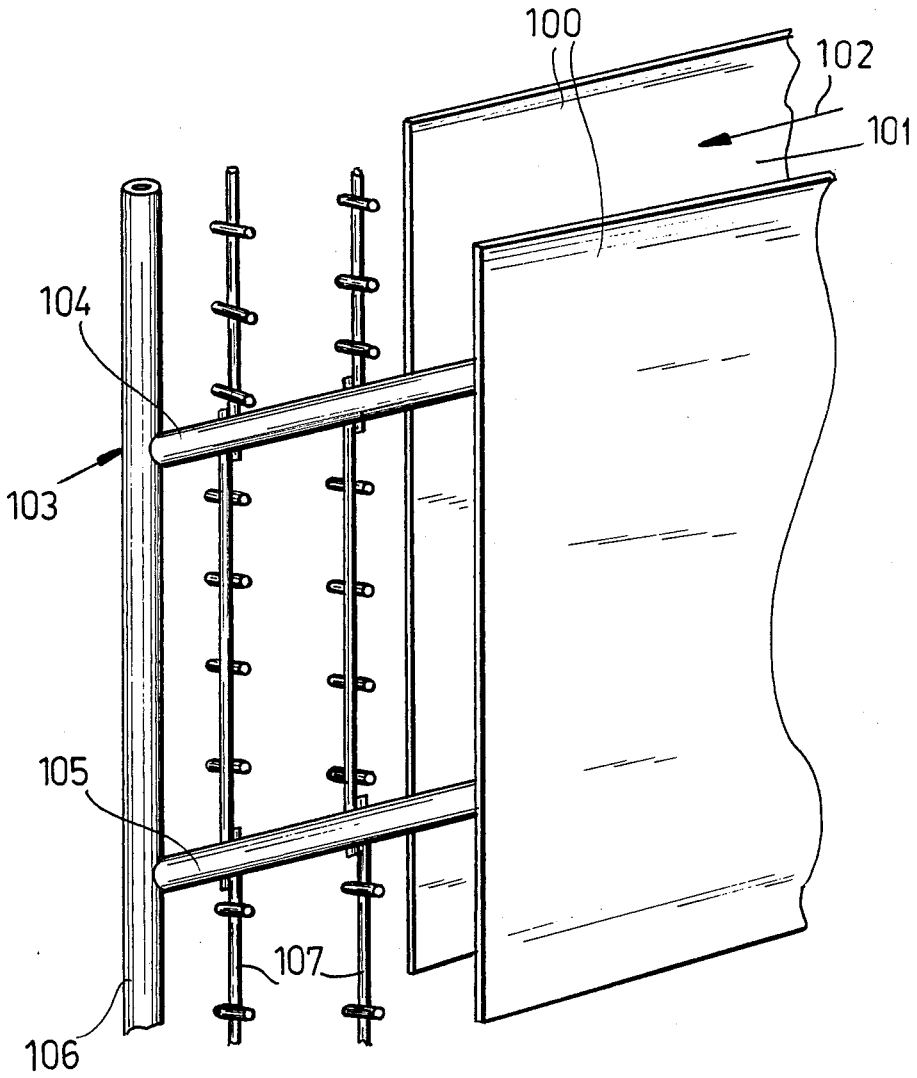
FIG. 4 is a partial highly diagrammatic perspective view illustrating principles of the invention.

Referring first to FIG. 4, it can be seen that the essential elements of an electrostatic precipitator include collector electrodes 100 which extend vertically and define between them gas passages, one of which has been shown at 101 in this FIG., the gas flow being represented by the arrow 102. Alternating with the connecting electrodes 100 are corona discharge electrode assemblies 103, only one of which has been illustrated between the electrodes 100. The assemblies 103 themselves are made up of the tube arrays of which two horizontal tubes 104 and 105 are visible and are shown to be welded to a vertical tube 106. In this assembly, corona electrodes 107 are tensioned and held as will be described in connection with FIG. 2, 2A, 3 and 3A where the electrodes themselves are indicated at 1 and 9 and the tubes at 7 respectively.

The housing for the electrostatic precipitator has not been illustrated and it will be apparent that the corona electrode assemblies are attached to one pole of a high-voltage direct current source as is customary while the other pole is at the potential of the collector electrodes 100 connected to the other pole of the source.

The electrostatic precipitator shown operates in the usual manner to remove the dust from the gas stream flow through the passages 102 by charging the dust particles and attracting the charged dust particles to the collector electrodes.

Figure 1:
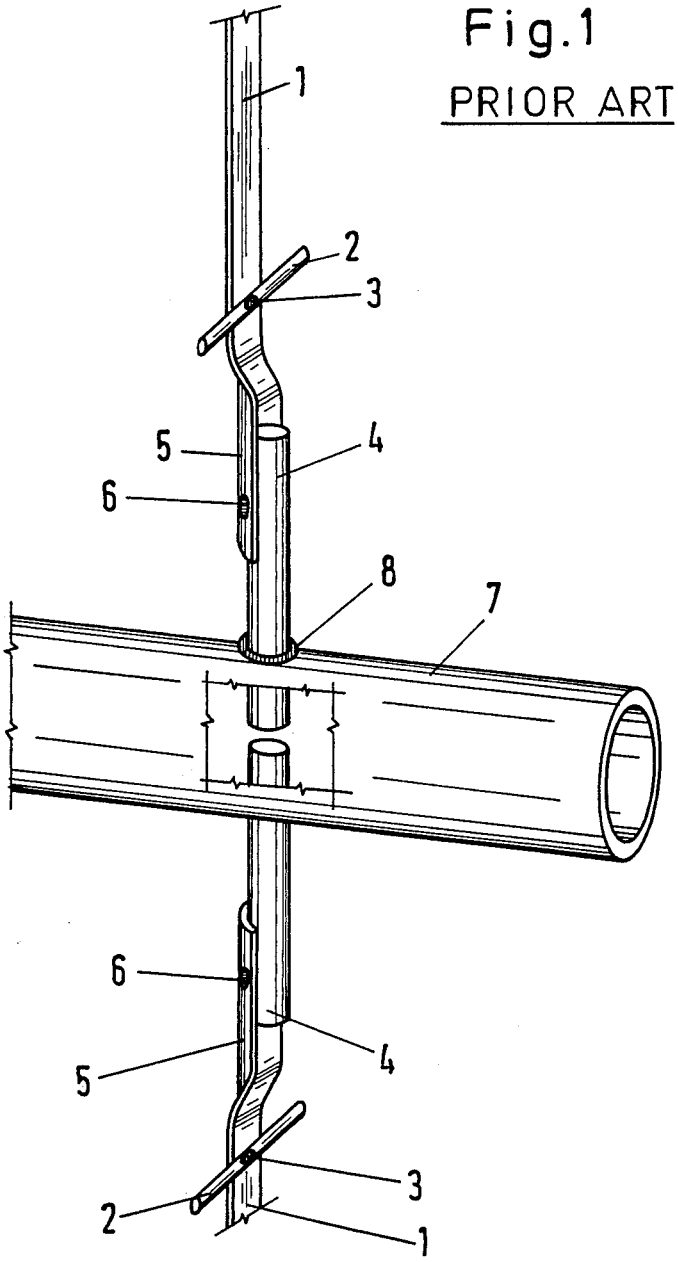
Fig.1 PRIOR ART
FIG. 1 is a perspective view which shows a joint between a corona electrode and a tensioning frame in accordance with the prior art.

As can be seen from FIG. 1, in a prior art arrangement, each corona electrode consists of an elongate striplike body 1, to which corona points 2 have been secured by spot welds 3. Each corona electrode is provided at its ends with weld-on end portions 4 which consist of sections of round material. End portions 5 of the corona electrodes conform to said weld-on end portions and are secured to them by spot welds 6. The corona electrodes are secured in tensioning frames 7 by seam welds 8.

For the reasons set forth in detail in the introductory part of the description, a plurality of corona electrode sections which are arranged one over the other should be located at the same "electrical center" if optimum separating rates are to be achieved. But this cannot be achieved unless the weld-on end portions have been inserted into the same bore of the tensioning frame, as has been shown. In that case the weld-on end portions can be inserted only to approximately the center of the tube and can be welded to the tensioning frame only at one point. Joints of that kind between the corona electrode and the tensioning frame have proved to be most susceptible to trouble.

For this reason, the invention teaches the provision of weld-on end portions 4 which are semicircular in cross-section, as is shown in FIGS. 2 and 2A, in which the reference numerals are the same as in FIG. 1. If it is desired or necessary to provide such weld-on end portions which have the same cross-sectional area as the weld-on end portions of the prior art, which are circular in cross-section, the bore in the tensioning frame must be larger in diameter by about 40%. This will be possible without difficulty. The design of the weld-on end portions in accordance with the invention, which are semicircular in cross-section, will permit a stable fixation in the tubes of the tensioning frames at two points and this will not cause the corona points to be appreciably spaced from the electrical center.

In the top and bottom tubes of a tensioning frame that space in the bore which is not occupied by the semicircular weld-on end portion is occupied by a short section **4*a*** made of the same material so that the conditions resulting from the fixation are the same there as in the intermediate tubes.

As can be seen from FIG. 2, moreover, the extremities 5 of the corona electrode 1 have semicylindrical shapes and receive the end portions which are formed by the semicircular section bores 4. Spot welds 6 secure the semicircular sections to the semicircular bars. The corona points 3 are formed by rod segments which are spot welded to the flat shank of the corona electrode.

A further development of the invention is shown in FIG. 3. In this case the body 9 of the corona electrode consists throughout its length of a material which is semicircular in cross-section. All other reference numerals have the same meanings as in FIGS. 1 and 2. Whereas that embodiment involves a somewhat higher expenditure of material than the striplike corona electrode body, it has a somewhat higher stability and the spot welds 6 may be omitted. Here, the corona electrode points are even closer to the electrical center.

We claim:

1. A corona electrode assembly for an electrostatic precipitator in which a plurality of the assemblies alternate with dust-collecting electrodes, the assembly comprising:

a tensioning frame having at least one pair of mutually parallel, longitudinally extending, and transversely spaced tubes each formed with a plurality of transversely throughgoing generally circular holes; and a plurality of corona electrodes spanning between the tubes, the corona electrodes each being formed of a plurality of transversely aligned portions each in turn having an elongated shank provided with protruding corona points and ends of semicircular cross section, each hole receiving and being completely transversely traversed by the ends of two of the electrode portions; and a respective weld at each hole securing the respective ends therein with each of the respective electrode portions extending transversely from the respective hole opposite from and transversely aligned with the other electrode portion engaged therein.

2. The assembly defined in claim 1 wherein the shank of each of said electrode portions is of semicircular cross section over its entire length.

3. The assembly defined in claim 1 wherein said points are formed by rod segments spot-welded to the respective shanks.

4. The assembly defined in claim 1 wherein each end is formed as a bar of semicircular cross section welded to an extremity of the respective shank.

5. The assembly defined in claim 4 wherein each of said extremities of said shanks is formed as a semicircular shell receiving the respective bar.

6. The assembly defined in claim 5 wherein each shank is flat between the respective semicircular shells at the extremities thereof.

* * * * *